US011214751B2

(12) United States Patent
Nagase et al.

(10) Patent No.: US 11,214,751 B2
(45) Date of Patent: Jan. 4, 2022

(54) METALWORKING OIL COMPOSITION AND METALWORKING METHOD

(71) Applicants: IDEMITSU KOSAN CO., LTD., Chiyoda-ku (JP); NIPPON STEEL CORPORATION, Chiyoda-ku (JP)

(72) Inventors: Naoki Nagase, Chiba (JP); Hideo Sugii, Chiba (JP); Keiji Noma, Narashino (JP); Seikichi Kitabatake, Narashino (JP); Isao Noguchi, Narashino (JP); Takeshi Kubota, Chiyoda-ku (JP); Shuichi Yamazaki, Chiyoda-ku (JP); Eisuke Minematsu, Chiyoda-ku (JP)

(73) Assignees: IDEMITSU KOSAN CO., LTD., Chiyoda-ku (JP); NIPPON STEEL CORPORATION, Chiyoda-ku (JP)

( * ) Notice: Subject to any disclaimer, the term of this patent is extended or adjusted under 35 U.S.C. 154(b) by 0 days.

(21) Appl. No.: 16/327,625

(22) PCT Filed: Aug. 24, 2017

(86) PCT No.: PCT/JP2017/030327

§ 371 (c)(1),
(2) Date: Feb. 22, 2019

(87) PCT Pub. No.: WO2018/038208

PCT Pub. Date: Mar. 1, 2018

(65) Prior Publication Data

US 2019/0225908 A1 Jul. 25, 2019

(30) Foreign Application Priority Data

Aug. 26, 2016 (JP) ..... JP2016-166088

(51) Int. Cl.

| | |
|---|---|
| ***C10M 169/04*** | (2006.01) |
| ***C10M 141/10*** | (2006.01) |
| ***C10M 137/04*** | (2006.01) |
| ***C10M 129/72*** | (2006.01) |
| ***C10M 129/50*** | (2006.01) |
| *C10M 129/74* | (2006.01) |
| *C10M 137/08* | (2006.01) |
| *C10N 20/02* | (2006.01) |
| *C10N 30/12* | (2006.01) |
| *C10N 40/20* | (2006.01) |

(52) U.S. Cl.

CPC ..... *C10M 141/10* (2013.01); *C10M 129/50* (2013.01); *C10M 129/72* (2013.01); *C10M 137/04* (2013.01); *C10M 169/04* (2013.01); *C10M 129/74* (2013.01); *C10M 137/08* (2013.01); *C10M 2207/28* (2013.01); *C10M 2223/041* (2013.01); *C10N 2020/02* (2013.01); *C10N 2030/12* (2013.01); *C10N 2040/20* (2013.01)

(58) Field of Classification Search

CPC ..... C10M 141/10; C10M 129/50; C10M 129/72; C10M 169/04; C10M 137/04; C10M 137/08; C10M 129/74; C10M 2223/041; C10M 2207/28; C10M 2223/049; C10M 2207/026; C10M 2215/064; C10M 2215/08; C10M 2215/04; C10M 2215/223; C10M 2207/282; C10M 2207/285; C10M 2207/283; C10M 2203/1006; C10N 2240/40; C10N 2230/12; C10N 2220/022; C10N 2230/02; C10N 2020/02; C10N 2040/20; C10N 2030/12

See application file for complete search history.

(56) References Cited

U.S. PATENT DOCUMENTS

| | | | | |
|---|---|---|---|---|
| 4,430,234 | A | 2/1984 | Hasegawa et al. | |
| 5,955,403 | A | 9/1999 | Wong | |
| 2006/0240996 | A1* | 10/2006 | Hayashi | C10M 173/02 508/198 |
| 2012/0053098 | A1 | 3/2012 | Okada et al. | |
| 2012/0217443 | A1* | 8/2012 | Shibata | C10M 171/02 252/395 |
| 2015/0166926 | A1 | 6/2015 | Scherer et al. | |

(Continued)

FOREIGN PATENT DOCUMENTS

| | | | |
|---|---|---|---|
| CN | 102421881 | A | 4/2012 |
| CN | 102746924 | A | 10/2012 |
| CN | 102822325 | A | 12/2012 |

(Continued)

OTHER PUBLICATIONS

Office Action dated Apr. 12, 2019 in Vietnamese Patent Application No. 1-2019-00965 with English translation.

Taiwanese Office Action dated May 21, 2018, in Patent Application No. 106128836, 6 pages (with English Translation of Category of Cited Documents).

(Continued)

*Primary Examiner* — Taiwo Oladapo

(74) *Attorney, Agent, or Firm* — Oblon, McClelland, Maier & Neustadt, L.L.P.

(57) ABSTRACT

Provided are: a metalworking oil composition having excellent workability and rust inhibiting performance, which is prepared by blending (A) at least one carboxylate selected from a polyhydric alcohol ester of a monocarboxylic acid and a monohydric alcohol ester of a polycarboxylic acid, (B) a phosphorus-containing compound, and (C) a rust inhibitor, wherein the monocarboxylic acid has 9 or more and 21 or less carbon atoms, and the content of the carboxylate is 0.6% by mass or more based on the total amount of the composition; and a metalworking method using the composition.

17 Claims, No Drawings

(56) References Cited

U.S. PATENT DOCUMENTS

2016/0083671 A1* 3/2016 Yao ..... C10M 169/04
508/296

FOREIGN PATENT DOCUMENTS

| | | | | |
|---|---|---|---|---|
| CN | 103384730 | A | 11/2013 | |
| CN | 104263476 | A | 1/2015 | |
| CN | 104411674 | A | 3/2015 | |
| CN | 105154180 | A | 12/2015 | |
| EP | 0 952 207 | A2 | 10/1999 | |
| JP | 50-8804 | A | 1/1975 | |
| JP | 50-67806 | A | 6/1975 | |
| JP | 58-8799 | A | 1/1983 | |
| JP | S58-83097 | A | 5/1983 | |
| JP | 58-109597 | A | 6/1983 | |
| JP | 63-308096 | A | 12/1988 | |
| JP | 2-18496 | A | 1/1990 | |
| JP | H5-9491 | | 1/1993 | |
| JP | 6-136374 | A | 5/1994 | |
| JP | H6-220477 | | 8/1994 | |
| JP | H6-220477 | A | 8/1994 | |
| JP | H8-34986 | A | 2/1996 | |
| JP | 8-253786 | A | 10/1996 | |
| JP | 2000-219890 | A | 8/2000 | |
| JP | 2000-319680 | | 11/2000 | |
| JP | 2000-351984 | A | 12/2000 | |
| JP | 2002-285180 | A | 10/2002 | |
| JP | 2004-346091 | A | 12/2004 | |
| JP | 2005-232417 | A | 9/2005 | |
| JP | 2007-126585 | | 5/2007 | |
| WO | WO 01/46350 | A1 | 6/2001 | |
| WO | WO-2004094575 | A1 * | 11/2004 | ..... C10M 163/00 |

OTHER PUBLICATIONS

Extended European Search Report dated Feb. 17, 2020, in Patent Application No. 17843684.6, 8 pages.
XP-002797358, Database WPI Week 200479, 2004, Thomson Scientific, London, GB, AN 2004-804519, 4 pages.
XP-002797359, Database WPI Week 199009, 1990, Thomson Scientific, London, GB, AN 1990-064237, 2 pages.
Japanese Office Action dated Jun. 2, 2020, in Patent Application No. 2016-166088, 12 pages (with unedited computer generated English translation).
Japanese Third Party Opinion dated Mar. 24, 2020, in Patent Application No. 2016-166088, 2 pages.
Office Action dated Dec. 22, 2020 in Japanese Patent Application No. 2016-166088, dated (with computer-generated English translation).
Kachio SATO, "Oiliness Improvers and Extreme Pressure Additives", Lubrication, 1970, 43-62 pages, vol. 15, No. 6, Japan.
Office Action dated Dec. 31, 2020 in Indian Patent Application No. 201947007424.
Office Action dated Nov. 5, 2020 in European Application No. 17843684.6.
Office Action issued Nov. 23, 2020 in Korean Application No. 10-2019-7005540 (w/ English translation).
Office Action issued in in Chinese Application No. 201780052434.8, dated Jun. 16, 2021.
Office Action issued in Japanese Application No. 2016-166088, dated Jul. 6, 2021, (w/Computer-generated English translation).
Office Action dated May 24, 2021 in Korean Application No. 10-2019-7005540 (w/ computer-generated English Translation).
International Search Report dated Sep. 26, 2017 in PCT/JP2017/030327 filed on Aug. 24, 2017.
Office Communication dated Oct. 13, 2021 in European Patent Application No. 17 843 684.6.

* cited by examiner

METALWORKING OIL COMPOSITION AND METALWORKING METHOD

RELATED APPLICATION

This application is a national stage entry of PCT/JP2017/030327, filed Aug. 24, 2017, which claims priority from Japanese Patent Application No. 2016-166088, filed Aug. 26, 2016, which are incorporated by reference in their entirety.

TECHNICAL FIELD

The present invention relates to a metalworking oil composition and a metalworking method using the composition.

BACKGROUND ART

Heretofore, a metalworking oil composition for use for metalworking such as plastic working, cutting work or grinding work is required to have high workability in order to reduce tool wear and at the same time to better the shape and the surface condition of worked products under severe lubrication conditions. For attaining excellent workability and tool wear reduction, various kinds of extreme pressure agents and oiliness agents are blended in a metalworking oil composition. On the other hand, users using a metalworking oil composition desire a metalworking oil composition of a type not requiring washing treatment in after-working, from the viewpoint of a labor-saving in after-working and environmental problems. As a metalworking oil composition capable of satisfying such users' demand, for example, a metalworking oil composition prepared by blending an α-olefin and a phosphorus-containing compound in a base oil has been proposed (for example, see PTL 1). The metalworking oil composition can omit washing treatment in after-working, and is especially favorable for working of stainless materials, surface-treated steel plates and aluminum materials.

CITATION LIST

Patent Literature

PTL 1: JP 8-253786 A

SUMMARY OF INVENTION

Technical Problem

Meanwhile, in the case where materials to be worked are stored for a long period of time until being worked after having been coated, for example, when materials to be worked are coated with a metalworking oil composition and are to be worked in foreign countries, there may occur a problem of rust generation. However, the metalworking oil composition described in PTL 1 could not be said to be always sufficient in point of rust inhibition.

The present invention has been made in consideration of the above-mentioned situation, and an object thereof is to provide a metalworking oil composition having excellent workability and also having rust inhibiting performance and a metalworking method using the composition.

Solution to Problem

As a result of assiduous studies, the present inventors have found that the following invention can solve the above-mentioned problems. Specifically, the present invention provides a metalworking oil composition having the constitution mentioned below, and a metalworking method using the composition.

1. A metalworking oil composition including, as blended therein, (A) at least one carboxylate selected from a polyhydric alcohol ester of a monocarboxylic acid and a monohydric alcohol ester of a polycarboxylic acid, (B) a phosphorus-containing compound, and (C) a rust inhibitor, wherein the monocarboxylic acid has 9 or more and 21 or less carbon atoms, and the content of the carboxylate is 0.6% by mass or more based on the total amount of the composition.
2. A metalworking method including using the metalworking oil composition of the above 1.

Advantageous Effects of Invention

According to the present invention, there can be provided a metalworking oil composition having excellent workability and also having rust inhibiting performance, and a metalworking method using the composition.

DESCRIPTION OF EMBODIMENTS

Embodiments of the present invention (hereinunder also referred to as "the present embodiment") are described below. In this description, the numerical values of "X or more" and "Y or less" relating to the description of a numerical range are numerical values that can be combined in any manner.

Also in this description, for example, a composition defined as "a composition prepared by blending a component (I), a component (II) and a component (III)" includes not only "a composition containing a component (I), a component (II) and a component (III)" but also any other embodiments of "a composition containing a reaction product resulting from reaction of any of a component (I), a component (II) and a component (III)", and a "composition containing, in place of at least one component of a component (I), a component (II) and a component (III), a modified derivative thereof resulting from modification with a component in the composition".

[Metalworking Oil Composition]

The metalworking oil composition of the present embodiment is one prepared by blending (A) at least one carboxylate selected from a polyhydric alcohol ester of a monocarboxylic acid and a monohydric alcohol ester of a polycarboxylic acid (hereinafter may be simply referred to as (A) a carboxylate), (B) a phosphorus-containing compound, and (C) a rust inhibitor, the monocarboxylic acid has 9 or more and 21 or less carbon atoms, and the content of the carboxylate is 0.6% by mass or more based on the total amount of the composition. Preferably, the metalworking oil composition of the present embodiment is one prepared by further blending (D) at least one base oil selected from a mineral oil and a synthetic oil having a kinematic viscosity at 40° C. of 0.5 $mm^2/s$ or more and 20 $mm^2/s$ or less therein (hereinafter may be simply referred to as (D) a base oil).

<(A) Carboxylate>

The carboxylate (A) is least one selected from a polyhydric alcohol ester of a monocarboxylic acid and a monohydric alcohol ester of a polycarboxylic acid, and the monocarboxylic acid has 9 or more and 21 or less carbon atoms.

The polyhydric alcohol ester of a monocarboxylic acid is an ester of a monocarboxylic acid and a polyhydric alcohol.

The monocarboxylic acid to constitute the polyhydric alcohol ester of a monocarboxylic acid is one having 9 or more and 21 or less carbon atoms. When the carbon number is less than 9, workability and rust inhibiting performance could not be attained. On the other hand, when the carbon number is more than 21, solubility especially in the base oil (D) could not be attained and the composition may be unstable. In consideration of workability and rust inhibiting performance, the carbon number of the monocarboxylic acid is preferably 12 or more, more preferably 14 or more, and on the other hand, in consideration of solubility in the other components, the carbon number is preferably 20 or less, more preferably 18 or less. The monocarboxylic acid may be linear, branched or cyclic, and may be saturated or unsaturated.

Examples of the monocarboxylic acid include an aliphatic monocarboxylic acid, such as a saturated monocarboxylic acid such as pelargonic acid, capric acid, lauric acid, tridecanoic acid, myristic acid, palmitic acid, margaric acid, stearic acid, isostearic acid, nonadecylic acid, arachidic acid, and henicosylic acid; and an unsaturated monocarboxylic acid such as myristoleic acid, palmitoleic acid, sapienic acid, oleic acid, linolic acid, linoleic acid, gadoleic acid, and eicosenoic acid; an alicyclic carboxylic acid such as ethylcyclohexanecarboxylic acid, propylcyclohexanecarboxylic acid, butylcyclohexanecarboxylic acid, phenylcyclopentanecarboxylic acid, and phenylcyclohexanecarboxylic acid; and an aromatic monocarboxylic acid such as biphenylcarboxylic acid, benzoylbenzoic acid, naphthalenecarboxylic acid, and anthracenecarboxylic acid.

Above all, in consideration of workability, rust inhibiting performance and solubility in other components, a saturated monocarboxylic acid such as lauric acid, myristic acid, palmitic acid and stearic acid, and an unsaturated monocarboxylic acid such as oleic acid, linolic acid and linoleic acid are preferred; lauric acid, myristic acid, palmitic acid, stearic acid and oleic acid are more preferred; and oleic acid is even more preferred.

In consideration of workability and rust inhibiting performance, the polyhydric alcohol, that is, the polyhydric alcohol to constitute a polyhydric alcohol ester of a monocarboxylic acid, is preferably one having a carbon number of 2 or more, more preferably 3 or more, even more preferably 4 or more. On the other hand, in consideration of solubility in other components, the carbon number is preferably 15 or less, more preferably 10 or less, even more preferably 8 or less. The polyhydric alcohol may be linear, branched or cyclic, and may be saturated or unsaturated.

From the viewpoint of workability, rust inhibiting performance and solubility in other components, preferred examples of the polyhydric alcohol include an aliphatic polyhydric alcohol such as a dihydric alcohol such as ethylene glycol, propylene glycol, propanediol, butylene glycol, butanediol, 2-methyl-1,3-prop anecliol, pentanediol, neopentyl glycol, hexanediol, 2-ethyl-2-methyl-1,3-propanecliol, heptanediol, 2-methyl-2-propyl-1,3-propanediol, 2,2-diethyl-1,3-propanecliol, octanecliol, nonanecliol, decanecliol, undecanediol, dodecanediol, tridecanediol, tetradecanediol, and pentadecanediol; and a tri or higher-hydric alcohol such as trimethylolethane, ditrimethylolethane, trimethylolpropane, ditrimethylolpropane, glycerin, pentaerythritol, dipentaerythritol, tripentaerythritol and sorbitol.

Above all, from the viewpoint of workability, rust inhibiting performance and solubility in other components, an aliphatic tri or higher-hydric alcohol is preferred, and trimethylolpropane and pentaerythritol are preferred.

The polyhydric alcohol also includes an aromatic dihydric alcohol such as catechol, resorcinol, hydroquinone, salicylic alcohol, and dihydroxydiphenyl; an alicyclic dihydric alcohol such as cyclohexanediol, and cyclohexanedimethanol; an aromatic trihydric alcohol such as pyrogallol, methylpyrogallol, ethylpyrogallol, various propylpyrogallols, and various butylpyrogallols; and an alicyclic trihydric alcohol such as cyclohexanetriol, and cyclohexanetrimethanol.

Specific examples of the polyhydric alcohol ester of a monocarboxylic acid preferably include an ester of a polyhydric alcohol which is pentaerythritol, such as various pentaerythritol oleates such as pentaerythritol monooleate, pentaerythritol dioleate, pentaerythritol trioleate, and pentaerythritol tetraoleate, various pentaerythritol stearates, various pentaerythritol laurates, various pentaerythritol myristates, and various pentaerythritol palmitates; and an ester of a polyhydric alcohol which is trimethylolpropane, such as various trimethylolpropane oleates such as trimethylolpropane monooleate, trimethylolpropane dioleate, and trimethylolpropane trioleate, various trimethylolpropane laurates, various trimethylolpropane myristates, and various trimethylolpropane palmitates. Above all, from the viewpoint of workability, various pentaerythritol oleates and various trimethylolpropane oleates are preferred, and pentaerythritol tetraoleate and trimethylolpropane trioleate are more preferred.

One kind alone of these polyhydric alcohol esters of a monocarboxylic acid may be used, or two or more kinds thereof may be used in combination. For example, regarding the above-mentioned various trimethylol oleates, those differing in point of the bonding number in the oleic acid moiety may be mixed, or, for example, various pentaerythritol oleates and various trimethylol oleates may be combined and used here.

The monohydric alcohol ester of a polycarboxylic acid is an ester of a monohydric alcohol and a polycarboxylic acid.

From the viewpoint of workability and rust inhibiting performance, the carbon number of the polycarboxylic acid to constitute the monohydric alcohol ester of a polycarboxylic acid is preferably 2 or more, more preferably 3 or more, even more preferably 4 or more. On the other hand, from the viewpoint of solubility in other components, the carbon number is preferably 18 or less, more preferably 12 or less, even more preferably 8 or less. The polycarboxylic acid may be linear, branched or cyclic, and may be saturated or unsaturated.

Preferred examples of the polycarboxylic acid include an aliphatic polycarboxylic acid such as succinic acid, adipic acid, pimellic acid, azelaic acid and sebacic acid; an alicyclic polycarboxylic acid such as cyclopentanedicarboxylic acid, cyclohexanedicarboxylic acid, and cyclohexanetricarboxylic acid; and an aromatic polycarboxylic acid such as phthalic acid, isophthalic acid, biphenyldicarboxylic acid, trimellitic acid, pyromellitic acid, naphthalenedicarboxylic acid, diphenic acid, naphthalenetricarboxylic acid, anthracenedicarboxylic acid, and pyrenedicarboxylic acid.

Above all, in consideration of workability, rust inhibiting performance and solubility in other components, an aromatic carboxylic acid is preferred, and trimellitic acid and pyromellitic acid are more preferred.

The carbon number of the monohydric alcohol, that is, the monohydric alcohol to constitute the monohydric alcohol ester of a polycarboxylic acid is, from the viewpoint of workability and rust inhibiting performance, preferably 9 or more, more preferably 12 or more. On the other hand, in consideration of solubility in other components, the carbon number is preferably 21 or less, more preferably 20 or less, even more preferably 18 or less. The monohydric alcohol may be linear, branched or cyclic, and may be saturated or unsaturated.

From the viewpoint of workability, rust inhibiting performance and solubility in other components, preferred examples of the monohydric alcohol include a saturated aliphatic monohydric alcohol such as pelargonic alcohol, capric alcohol, undecyl alcohol, lauryl alcohol, tridecyl alcohol, myristyl alcohol, pentadecyl alcohol, cetyl alcohol, stearyl alcohol, isostearyl alcohol, nonadecyl alcohol, arachidyl alcohol, and henicosyl alcohol; and an unsaturated aliphatic monohydric alcohol such as palmitoyl alcohol, elaidyl alcohol, oleyl alcohol, linoleyl alcohol, and linolenyl alcohol.

Above all, from the viewpoint of workability, rust inhibiting performance and solubility in other components, an unsaturated aliphatic monohydric alcohol is preferred, and oleyl alcohol is more preferred.

Preferred examples of the monohydric alcohol include an aromatic alcohol such as phenol, various cresols, various xylenols, various propylphenols, various butylphenols, benzyl alcohol, phenethyl alcohol, naphthol, and diphenylmethanol; and an alicyclic alcohol such as cyclopentyl alcohol, cyclohexyl alcohol, cyclohexanemethanol and cyclooctanol.

Specific examples of the monohydric alcohol ester of a polycarboxylic acid preferably include various trimellitic acid oleates such as trimellitic acid monooleate, trimellitic acid dioleate, and trimellitic acid trioleate; and various pyromellitic acid oleates.

One kind alone of these monohydric alcohol esters of a polycarboxylic acid may be used, or plural kinds thereof may be used in combination. For example, regarding the above-mentioned various trimellitic acid oleates, those differing in point of the bonding number in the oleic acid moiety may be mixed, or, for example, various trimellitic acid oleates and various pyromellitic acid oleates may be combined and used.

The content of the carboxylate (A) based on the total amount of the composition is 0.6% by mass by mass or more. When the content of the carboxylate (A) based on the total amount of the composition is less than 0.6% by mass or less, workability and rust inhibiting performance could not be attained. From the viewpoint of improving workability and rust inhibiting performance, the content is preferably 0.8% by mass or more, more preferably 1% by mass or more, even more preferably 1.5% by mass or more. The content of the carboxylate (A) based on the total amount of the composition is preferably 20% by mass or less, more preferably 15% by mass or less, even more preferably 10% by mass or less. When the content of the carboxylate (A) based on the total amount of the composition is 20% by mass or less, degreasability from materials to be worked is improved, whereby the washing treatment in a later process is facilitated or as the case may be, washing treatment itself may be omitted.

<(B) Phosphorus-Containing Compound>

Preferred examples of the phosphorus-containing compound (B) include a phosphate, an acid phosphate, a phosphite, an acid phosphite, and a phosphate amine salt. Above all, an acid phosphite is preferred. By using such a phosphorus-containing compound, workability and rust inhibiting performance are improved, and degreasability from materials to be worked is also improved, whereby the washing treatment in a later process is facilitated, or as the case may be, washing treatment itself may be omitted.

Examples of the phosphate include a trialkyl phosphate, a trialkenyl phosphate, a tricycloalkyl phosphate, a triaryl phosphate, a tricycloalkyl phosphate, and a triaralkyl phosphate.

In these phosphates, the alkyl group includes a linear or branched alkyl group having 1 to 18, preferably 1 to 12 carbon atoms, and examples thereof include a methyl group, an ethyl group, an n-propyl group, an isopropyl group, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, and various octadecyl groups.

The alkenyl group includes a linear or branched alkenyl group having preferably 2 to 18, more preferably 2 to 12 carbon atoms, and examples thereof include a vinyl group, an allyl group, a propenyl group, an isopropenyl group, various butenyl groups, various pentenyl groups, various hexenyl groups, various heptenyl groups, various octenyl groups, various nonenyl groups, various decenyl groups, various undecenyl groups, various dodecenyl groups, various tridecenyl groups, various tetradecenyl groups, various pentadecenyl groups, various hexadecenyl groups, various heptadecenyl groups, and various octadecenyl groups.

The cycloalkyl group includes a cycloalkyl group having preferably 3 to 18, more preferably 6 to 12 carbon atoms, and examples thereof include a cyclopropyl group, a cyclobutyl group, a cyclopentyl group, a cyclohexyl group, a cycloheptyl group, a cyclooctyl group, an adamantyl group, a bicyclohexyl group, and a decahydronaphthyl group.

The aryl group includes an aryl group having preferably 6 to 18, more preferably 6 to 12 carbon atoms, and examples thereof include a phenyl group, a naphthylphenyl group, a biphenylyl group, a terphenylyl group, a biphenylenyl group, a naphthyl group, a phenylnaphthyl group, an acenaphthylenyl group, an anthryl group, a benzoanthryl group, an aceanthryl group, a phenanthryl group, a benzophenanthryl group, a phenalenyl group, a fluorenyl group, and a dimethylfluorenyl group.

The aralkyl group includes an aralkyl group having preferably 7 to 18, more preferably 7 to 12 carbon atoms, and examples thereof include a benzyl group, a tolyl group, an ethylphenyl group, a phenethyl group, a dimethylphenyl group, a trimethylphenyl group, and a naphthylmethyl group.

The acid phosphate includes a monoalkyl acid phosphate, a dialkyl acid phosphate, a monoalkenyl acid phosphate, a dialkenyl acid phosphate, and a mixture thereof. Regarding the alkyl group and the alkenyl group in these acid phosphates, reference may be made to those exemplified for the alkyl group and the alkenyl group in the phosphates.

Examples of the phosphite include a trialkyl phosphite, a trialkenyl phosphite, a tricycloalkyl phosphite, a triaryl phosphite, and a triaralkyl phosphite. Regarding the alkyl group, the alkenyl group, the cycloalkyl group, the aryl group and the aralkyl group in these phosphites, reference may be made to those exemplified for the alkyl group, the alkenyl group, the cycloalkyl group, the aryl group and the aralkyl group in the phosphates.

The acid phosphite includes a monoalkyl acid phosphite, a dialkyl acid phosphite, a monoalkenyl acid phosphite, a dialkenyl acid phosphite, and a mixture thereof. Regarding the alkyl group and the alkenyl group in these acid phosphites, reference may be made to those exemplified for the alkyl group and the alkenyl group in the phosphates.

The phosphate amine salt includes an acid phosphate amine salt, and an acid phosphite amine salt, and among these, an acid phosphate amine salt is preferred.

The acid phosphate amine salt is a salt of an acid phosphate and an amine compound. Regarding the acid phosphate, reference may be made to those exemplified for the acid phosphate mentioned hereinabove.

The amine compound may be any of a primary amine, a secondary amine and a tertiary amine, but a primary amine is preferred. The amine compound is represented by a general formula $NR_3$, in which, preferably, one to three of R's each are a hydrocarbon group and the remaining R's are hydrogen atoms. Here, the hydrocarbon group is preferably an alkyl group or an alkenyl group, and may be linear, branched or cyclic, but is preferably linear or branched. The hydrocarbon group has preferably 6 to 20 carbon atoms, more preferably 8 to 20 carbon atoms.

Here, the primary amine includes hexylamine, octylamine, laurylamine, ridecylamine, myristylamine, stearylamine, oleylamine, and cyclohexylamine.

The secondary amine includes dihexylamine, dioctylamine, dilaurylamine, dimyristylamine, distearylamine, dioleylamine, and dicyclohexylamine.

The tertiary amine includes trihexylamine, trioctylamine, trilaurylamine, trimyristylamine, tristearylamine, trioleylamine, and tricyclohexylamine.

The content of the phosphorus-containing compound (B) as converted in terms of phosphorus atom based on the total amount of the composition is preferably 0.001% by mass or more, more preferably 0.005% by mass or more, even more preferably 0.01% by mass or more. When the content of the phosphorus-containing compound (B) as converted in terms of phosphorus atom based on the total amount of the composition is 0.001% by mass or more, workability and rust inhibiting performance may be improved. On the other hand, the content of the phosphorus-containing compound (B) as converted in terms of phosphorus atom based on the total amount of the composition is preferably 0.5% by mass or less, more preferably 0.1% by mass or less, even more preferably 0.05% by mass or less. When the content of the phosphorus-containing compound (B) as converted in terms of phosphorus atom based on the total amount of the composition is 0.5% by mass or less, degreasability from materials to be worked is improved, whereby the washing treatment in a later process is facilitated or as the case may be, washing treatment itself may be omitted.

<(C) Rust Inhibitor>

The rust inhibitor is preferably a nitrogen-containing compound that contains a nitrogen atom in the molecule, and examples thereof include an alkylamine compound such as an alkylamine having an alkyl group having 1 to 24 carbon atoms, an ethylene oxide (1 to 20 moles) adduct thereof, and a polyalkylamine; a sulfonate amine compound such as an alkyl sulfonate, an aryl sulfonate, an alkylaryl sulfonate, and a petroleum sulfonate; an acylsarcosine compound such as lauroylsarcosine, and oleoylsarcosine; an alkanolamine compound such as monoethanolamine, diethanolamine, triethanolamine, monoisopropanolamine, diisopropanolamine and triisopropanolamine; a cyclic amine ethylene oxide (1 to 20 moles) adduct composed of 6 to 24 carbon atoms; an amine having 2 or more nitrogen atoms such as ethylenediamine, diethylenetriamine, triethylenetetramine and tetraethylenepentamine, and an ethylene oxide (1 to 60 moles) adduct thereof; an imidazole compound such as imidazole, methylimidazole, ethylmethylimidazole, benzimidazole, aminobenzimidazole, phenylbenzimidazole, naphthoimidazole, triphenylimidazole, or imidazoline; a polyether amine and an alkenylsuccinic acid.

Above all, from the viewpoint of improving rust inhibiting performance, a rust inhibitor of an alkylamine compound, a sulfonate amine salt, an acylsarcosine compound and an imidazole compound is preferred.

The content of the rust inhibitor (C) based on the total amount of the composition is preferably 0.01% by mass or more, more preferably 0.05% by mass or more, even more preferably 0.1% by mass or more. When the content of the rust inhibitor is 0.01% by mass or more, rust inhibiting performance may be improved. On the other hand, the content of the rust inhibitor (C) based on the total amount of the composition is preferably 5% by mass or less, more preferably 3% by mass or less, even more preferably 2% by mass or less. When the content of the rust inhibitor (C) is 5% by mass or less based on the total amount of the composition, degreasability from materials to be worked is improved, whereby the washing treatment in a later process is facilitated or as the case may be, washing treatment itself may be omitted.

<(D) Base Oil>

Preferably, the metalworking oil composition of the present embodiment further contains at least one base oil selected from a mineral oil and a synthetic oil each having a kinematic viscosity at 40° C. of 0.5 $mm^2/s$ or more and 20 $mm^2/s$ or less. The base oil (D) may be a mineral oil or a synthetic oil.

The mineral oil includes a paraffin-base mineral oil, a naphthene-base mineral oil and an intermediate-base mineral oil. More specifically, these mineral oils include atmospheric residues obtained through atmospheric distillation of crude oils such as paraffin-base mineral oils, naphthene-base mineral oils or intermediate-base mineral oils; distillates obtained through reduced-pressure distillation of such atmospheric residues; mineral oils obtained by purifying the distillates through one or more purification treatments of solvent deasphalting, solvent extraction, hydrocracking, solvent dewaxing, catalytic dewaxing and hydrorefining.

The mineral oil may be one classified in any of Groups 1, 2 and 3 in the base oil category of API (American Petroleum Institute).

Examples of the synthetic oil include a poly-α-olefin such as a polybutene, an ethylene-α-olefin copolymer, an α-olefin homopolymer or copolymer; various esters such as a polyol ester, a dibasic acid ester, and a phosphate; various ethers such as a polyphenyl ether; a polyglycols; an alkylbenzene; an alkylnaphthalene; and a synthetic oil obtained through isomerization of wax produced through Fischer-Tropsch synthesis (GTL wax).

One kind alone of the above-mentioned mineral oils and synthetic oils may be used alone as the base oil (D), or plural kinds thereof may be used in combination. From the viewpoint of workability and oxidation stability, a mineral oil is preferably used.

The 40° C. kinematic viscosity of the base oil is 0.5 $mm^2/s$ or more, preferably 0.6 $mm^2/s$ or more, more preferably 0.7 $mm^2/s$ or more and even more preferably 1 $mm^2/s$ or more. When the 40° C. kinematic viscosity of the base oil (D) is 0.5 $mm^2/s$ or more, the flash point thereof may be high, thereby improving not only safety in handling but also workability. On the other hand, the 40° C. kinematic viscosity of the base oil (D) is 20 $mm^2/s$ or less, preferably 18 $mm^2/s$ or less, more preferably 15 $mm^2/s$ or less, even more preferably 10 $mm^2/s$ or less. When the 40° C. kinematic viscosity of the base oil (D) is 20 $mm^2/s$ or less, degreasability from materials to be worked is improved, whereby the washing treatment in a later process is facilitated or as the case may be, washing treatment itself may be omitted. Here, the kinematic viscosity is a value measured according to JIS K 2283:2000 using a glass-made capillary viscometer.

The flash point of the base oil (D) is preferably 25° C. or higher, more preferably 30° C. or higher, even more preferably 35° C. or higher. When the flash point is 25° C. or higher, stability in handling may be improved. On the other hand, the upper limit is not specifically limited, but is preferably 200° C. or lower, more preferably 100° C. or lower, even more preferably 70° C. or lower. Here, the flash point is a value measured in a COC method according to JIS K2265-4:2007.

The 90% distillation temperature of the base oil (D) is preferably within a range of 100° C. or higher and 450° C. or lower. When the 90% distillation temperature is 100° C. or higher, the flash point may be high therefore improving safety in handling and improving workability. From the same viewpoint, the 90% distillation temperature of the base oil (D) is more preferably 130° C. or higher, even more preferably 150° C. or higher. On the other hand, when the 90% distillation temperature of the base oil (D) is 450° C. or lower, degreasability from materials to be worked is improved, whereby the washing treatment in a later process is facilitated or as the case may be, washing treatment itself may be omitted. From the same viewpoint, the 90% distillation temperature of the base oil (D) is more preferably 350° C. or lower, even more preferably 270° C. or lower. Here, the 90% distillation temperature is a value measured according to JIS K2254:1998.

The sulfur content of the base oil (D) is preferably 500 ppm by mass or less, more preferably 100 ppm by mass or less, even more preferably 50 ppm by mass or less. When the sulfur content of the base oil (D) is 500 ppm by mass or less, materials to be worked may be difficult to stain or rust.

The content of the base oil (D) based on the total amount of the composition is preferably 50% by mass or more, more preferably 70% by mass or more, even more preferably 80% by mass or more. The content of the base oil (D) based on the total amount of the composition is preferably 99% by mass or less, more preferably 98.5% by mass or less, even more preferably 98% by mass or less.

<Other Additives>

The metalworking oil composition of the present embodiment may contain any other additives than the above-mentioned carboxylate (A), the phosphorus-containing compound (B), and the rust inhibitor (C) and also the base oil (D) to be used preferably, within a range not detracting from the object of the present invention, for example, any other additives such as an antioxidant, a viscosity index improver, a metal deactivator and an anti-foaming agent as appropriately selected and incorporated therein. One alone of these additives may be used or plural kinds thereof may be used in combination. The metalworking oil composition of the present embodiment may be prepared by blending the above-mentioned carboxylate (A), the phosphorus-containing compound (B) and the rust inhibitor (C) alone, or may be prepared by blending the carboxylate (A), the phosphorus-containing compound (B), the rust inhibitor (C) and the base oil (D) alone, or may be prepared by blending these components and further other additives.

The content of each of these additives is not specifically limited so far as it falls within a range not detracting from the object of the present invention, but in consideration of the effect of the additives to be added, the content is preferably 0.01% by mass or more and 10% by mass or less based on the total amount of the composition, more preferably 0.05% by mass or more and 8% by mass or less, even more preferably 0.1% by mass or more and 5% by mass or less.

(Antioxidant)

Examples of the antioxidant include an amine-based antioxidant such as a diphenylamine-based antioxidant, and a naphthylamine-based antioxidant; a phenyl-based antioxidant such as a monophenol-based antioxidant, a diphenol-based antioxidant, a hindered phenol-based antioxidant; a molybdenum-based antioxidant such as a molybdenum-amine complex to be prepared by reacting molybdenum trioxide and/or molybdic acid and an amine compound; a sulfur-based antioxidant such as phenothiazine, dioctadecyl sulfide, dilauryl-3,3'-thiodipropionate, 2-mercaptobenzimidazole; and a phosphorus-based antioxidant such as triphenyl phosphite, diisopropylmonophenyl phosphite, and monobutyldiphenyl phosphite.

(Viscosity Index Improver)

Examples of the viscosity index improver include a polymer such as a non-dispersant-type polymethacrylate, a dispersant-type polymethacrylate, an olefin-based copolymer (for example, an ethylene-propylene copolymer), a dispersant-type olefin-based copolymer, and a styrene-based copolymer (for example, a styrene-diene copolymer, a styrene-isoprene copolymer).

(Metal Deactivator)

Examples of the metal deactivator include a benzotriazole compound, a tolyltriazole compound, a thiadiazole compound, and an imidazole compound.

(Anti-Foaming Agent)

Examples of the anti-foaming agent include a silicone oil, a fluorosilicone oil, and a fluoroalkyl ether.

(Various Characteristics and Physical Properties of Metalworking Oil Composition)

The blending ratio of the carboxylate (A) to the phosphorus-containing compound (B) (ratio by mass, (A)/(B)) in the metalworking oil composition of the present embodiment is preferably 1 or more, more preferably 3 or more, even more preferably 4 or more. When (A)/(B) is 1 or more, workability and rust inhibiting performance may be improved. From the same viewpoint, (A)/(B) is preferably 15 or less, more preferably 13 or less, even more preferably 12 or less.

The blending ratio of the carboxylate (A) to the rust inhibitor (C) (ratio by mass, (A)/(C)) in the metalworking oil composition of the present embodiment is preferably 0.5 or more, more preferably 1.5 or more, even more preferably 2.5 or more. When (A)/(C) is 1.5 or more, workability and rust inhibiting performance may be improved. From the same viewpoint, (A)/(C) is preferably 15 or less, more preferably 13 or less, even more preferably 12 or less.

The blending ratio of the phosphorus-containing compound (B) to the rust inhibitor (C) (ratio by mass, (B)/(C)) in the metalworking oil composition of the present embodiment is preferably 0.05 or more, more preferably 0.1 or more, even more preferably 0.2 or more. When (B)/(C) is 0.05 or more, workability and rust inhibiting performance may be improved. From the same viewpoint, (B)/(C) is preferably 5 or less, more preferably 3 or less, even more preferably 2 or less.

The 40° C. kinematic viscosity of the metalworking oil composition of the present embodiment is preferably 0.5 $mm^2/s$ or more, more preferably 1 $mm^2/s$ or more. When the 40° C. kinematic viscosity is 0.1 $mm^2/s$ or more, the flash point may be high to improve safety in handling and improve workability. On the other hand, the 40° C. kinematic viscosity of the metalworking oil composition is preferably 20 $mm^2/s$ or less, more preferably 10 $mm^2/s$ or less. When the 40° C. kinematic viscosity is 20 $mm^2/s$ or less, degreasability from materials to be worked is improved, whereby the washing treatment in a later process is facilitated or as the case may be, washing treatment itself may be omitted.

The flash point of the metalworking oil composition of the present embodiment is preferably 25° C. or higher, more preferably 30° C. or higher, even more preferably 35° C. or higher. When the flash point is 25° C. or higher, safety in handling is improved. On the other hand, the upper limit is not specifically limited, but is, for example, preferably 200° C. or lower, more preferably 100° C. or lower, even more preferably 70° C. or lower.

The nitrogen atom content in the metalworking oil composition of the present embodiment is preferably 10 ppm by mass or more, more preferably 30 ppm by mass or more, even more preferably 50 ppm by mass or more. When the nitrogen atom content is 10 ppm by mass or more, improving antioxidation performance and rust inhibiting performance may be expected. On the other hand, the nitrogen atom content in the metalworking oil composition is, though not specifically limited but from the viewpoint of effectively improving antioxidation performance and rust inhibiting performance, preferably 1,000 ppm by mass or less, more preferably 800 ppm by mass or less, even more preferably 600 ppm by mass or less.

As described hereinabove, the metalworking oil composition of the present embodiment has excellent workability and has rust inhibiting performance, and is also excellent in degreasability from materials to be worked, and therefore can facilitate the washing treatment in a later process, or as the case may be, washing treatment itself may be omitted.

Taking advantage of such characteristics thereof, the metalworking oil composition of the present embodiment can be favorably used, for example, for plastic working, especially shearing work. In addition, the metalworking oil composition of the present embodiment has rust inhibiting performance, and therefore in the case where a material to be worked is coated with a metalworking oil composition and then kept as such for a long period of time until metalworking, for example, in the case where a pre-process of coating is carried out in Japan and then a process of metalworking is carried out in foreign countries, use of the metalworking oil composition of the present embodiment is effective.

The materials to be worked using the metalworking oil composition of the present embodiment are not specifically limited, but the metalworking oil composition is especially favorably used for silicon steel plates.

[Metalworking Method]

The metalworking method of the present embodiment is a metalworking method using the metalworking oil composition of the present embodiment mentioned hereinabove. The metalworking oil composition to be used in the metalworking method of the present embodiment has excellent workability and has rust inhibiting performance, and is also excellent in degreasability from materials to be worked, and therefore can facilitate the washing treatment in a later process, or as the case may be, washing treatment itself may be omitted. Consequently, for example, the method is favorably used for plastic working, especially shearing work. The materials to be worked in the metalworking method are not specifically limited, but the method is especially favorably used for silicon steel plates.

EXAMPLES

The present invention is hereunder more specifically described by reference to Examples, but it should be construed that the present invention is by no means limited thereto.

Examples 1 to 8 and Comparative Examples 1 to 7

Metalworking oil compositions were prepared in the blending ratio (% by mass) shown in Table 1 and Table 2. The resultant metalworking oil compositions were tested in various tests according to the methods mentioned below, and the physical properties thereof were evaluated. The evaluation results are shown in Table 1 and Table 2. The details of the components used in Examples, as shown in Table 1 and Table 2, are described below.

A-1: pentaerythritol tetraoleate (carboxylate (A))

A-2: trimethylolpropane trioleate (carboxylate (A))

NA-1: tetraoctyl pentaerythritol (ester not carboxylate (A))

NA-2: 2-ethylhexyl palmitate (ester not carboxylate (A))

B-1: phosphate (phosphorus-containing compound (B)), triaryl phosphate "REOFOS 110" (trade name) by Ajinomoto Fine-Techno Co., Inc.

B-2: acid phosphate (phosphorus-containing compound (B)), dioleyl hydrogenphosphite, "JP 218-0-R" (trade name) by Johoku Chemical Co., Ltd.

C-1: carboxy-imidazoline (imidazole)-based antiseptic (rust inhibitor (C)), "HiTEC536" (trade name) by Cooper Industries Japan K.K.

C-2: alkyl sulfonate amine salt (rust inhibitor (C)), "NA-SULEDS" (trade name) by King Industries Corporation C-3: Oleoylsarcosine, "Sarcosyl O" (trade name) by Ciba-Geigy Japan Ltd. Antioxidant A: phenol-based antioxidant, "Irganox 1067" (trade name) by Ciba-Geigy Japan Ltd.

Antioxidant B: amine-based antioxidant, "Irganox L57" (trade name) by Ciba-Geigy Japan Ltd.

D: paraffin-base mineral oil, 40° C. kinematic viscosity 1 $mm^2/s$, flash point 41° C.

<Methods for Measurement of Properties>

The properties of the metalworking oil compositions were measured according to the following methods.

(1) Kinematic Viscosity

The kinematic viscosity at 40° C. was measured according to JIS K 2283:2000.

(2) Phosphorus Atom Content

Measured according to JIS-5S-38-92.

(3) Nitrogen Atom Content

Measured according to JIS K2609:1998.

<Evaluation Methods>

The metalworking oil compositions were evaluated according to the following methods.

(1) Test Material

A test material (surface-treated) corresponding to 50A1300, as defined for non-oriented magnetic steel sheets in JIS C 2552, was used.

(2) Workability (Blanking Test)

Using the following die, the test material was tested in a blanking test under the following condition to confirm (Evaluation Item 1): (a) a shear surface ratio and (b) a burr height of the cross-sectional surface of the blanked plate, and (Evaluation Item 2): (a) a number and (b) a depth of the longitudinal streaks in the cross-sectional surface of the blanked plate, and evaluated according to the following criteria. A comprehensive evaluation of the Evaluation Item 1 and the Evaluation Item 2 was also made.

(Evaluation Item 1)

A: As compared with the test material after the blanking test not using a metalworking oil composition, the test material was improved in point of both the items (a) and (b).

B: As compared with the test material after the blanking test not using a metalworking oil composition, the test material was improved in point of any one of the items (a) and (b).

C: As compared with the test material after the blanking test not using a metalworking oil composition, the test material was not improved in point of both the items (a) and (b).

(Evaluation Item 2)

A: As compared with the test material after the blanking test not using a metalworking oil composition, the test material was improved in point of both the items (a) and (b).

B: As compared with the test material after the blanking test not using a metalworking oil composition, the test material was improved in point of any one of the items (a) and (b).

C: As compared with the test material after the blanking test not using a metalworking oil composition, the test material was not improved in point of both the items (a) and (b).

(Comprehensive Evaluation)

A: "A" was given for both the Evaluation Items 1 and 2.

B: "A" was given for the Evaluation Item 1, but "B" was given for the Evaluation Item 2.

C: "B" was given for both the Evaluation Items 1 and 2, or "B" was given for the Evaluation Item 1, or "C" was given for any of the Evaluation Items.

(3) Evaluation of Rust Inhibiting Performance

After tested according to the humidity cabinet test defined in JIS K2246:2007, the test material was evaluated in point of the degree of rust generation. Specifically, as the test material, those prepared by blanking into a size of 5×25 mm in the above-mentioned blanking test were used. The test materials were kept in a humidity cabinet for 4, 8 or 12 hours, the cut edge of the test material was visually observed.

As a result of visual observation, the test materials were evaluated according to the following criteria.

A: No rust was seen even after 12 hours.

B: No rust was seen even after 8 hours.

C: Rust was seen at the time after 4 hours.

TABLE 1

| | | Example | | | | | | | |
|---|---|---|---|---|---|---|---|---|---|
| | | 1 | 2 | 3 | 4 | 5 | 6 | 7 | 8 |
| Blending Amount of Each Component (% by mass) | A-1 | 3 | 1 | — | 3 | 3 | 3 | 3 | 3 |
| | A-2 | — | — | 3 | — | — | — | — | — |
| | NA-1 | — | — | — | — | — | — | — | — |
| | NA-2 | — | — | — | — | — | — | — | — |
| | B-1 | 0.3 | 0.3 | 0.3 | — | 0.3 | 0.3 | 0.3 | 0.3 |
| | B-2 | — | — | — | 0.3 | — | — | — | — |
| | C-1 | 0.5 | 0.5 | 0.5 | 0.5 | 0.3 | 1 | — | — |
| | C-2 | — | — | — | — | — | — | 0.5 | — |
| | C-3 | — | — | — | — | — | — | — | 0.5 |
| | D | 96 | 98 | 96 | 96 | 96.2 | 95.5 | 96 | 96 |
| | Antioxidant A | 0.1 | 0.1 | 0.1 | 0.1 | 0.1 | 0.1 | 0.1 | 0.1 |
| | Antioxidant B | 0.1 | 0.1 | 0.1 | 0.1 | 0.1 | 0.1 | 0.1 | 0.1 |
| | Total | 100 | 100 | 100 | 100 | 100 | 100 | 100 | 100 |
| Properties of Composition | 40° C. Kinematic Viscosity ($mm^2/s$) | 1.5 | 1.4 | 1.5 | 1.5 | 1.5 | 1.5 | 1.5 | 1.5 |
| | Phosphorus Content (% by mass) | 0.02 | 0.02 | 0.02 | 0.02 | 0.02 | 0.02 | 0.02 | 0.02 |
| | Nitrogen Content (ppm by mass) | 150 | 150 | 150 | 150 | 110 | 250 | 150 | 250 |
| Evaluation of Workability | Evaluation Item 1 | A | A | A | A | A | A | A | A |
| | Evaluation Item 2 | A | B | A | A | A | A | A | A |
| | Comprehensive Evaluation | A | B | A | A | A | A | A | A |
| Evaluation of Rust Inhibiting Performance | Evaluation | A | A | A | B | A | A | A | A |

TABLE 2

| | | Comparative Example | | | | | | |
|---|---|---|---|---|---|---|---|---|
| | | 1 | 2 | 3 | 4 | 5 | 6 | 7 |
| Blending Amount of Each Component (% by mass) | A-1 | — | — | 3 | 0.5 | 0.5 | 0.5 | 3 |
| | A-2 | — | — | — | — | — | — | — |
| | NA-1 | 3 | — | — | — | — | — | — |
| | NA-2 | — | 3 | — | — | — | — | — |
| | B-1 | 0.3 | 0.3 | 0.3 | 0.3 | 0.3 | — | — |
| | B-2 | — | — | — | — | — | 0.3 | — |
| | C-1 | 0.5 | 0.5 | — | 0.5 | — | — | 0.5 |
| | C-2 | — | — | — | — | — | — | — |
| | C-3 | — | — | — | — | — | — | — |
| | D | 96 | 96 | 96.5 | 98.6 | 99 | 99 | 96.3 |

TABLE 2-continued

| | | Comparative Example | | | | | | |
|---|---|---|---|---|---|---|---|---|
| | | 1 | 2 | 3 | 4 | 5 | 6 | 7 |
| | Antioxidant A | 0.1 | 0.1 | 0.1 | 0.1 | 0.1 | 0.1 | 0.1 |
| | Antioxidant B | 0.1 | 0.1 | 0.1 | 0.1 | 0.1 | 0.1 | 0.1 |
| | Total | 100 | 100 | 100 | 100 | 100 | 100 | 100 |
| Properties of Composition | 40° C. Kinematic Viscosity ($mm^2/s$) | 1.4 | 1.4 | 1.5 | 1.4 | 1.4 | 1.4 | 1.4 |
| | Phosphorus Content (% by mass) | 0.02 | 0.02 | 0.02 | 0.02 | 0.02 | 0.02 | 0 |
| | Nitrogen Content (ppm by mass) | 150 | 150 | 50 | 150 | 50 | 50 | 150 |
| Evaluation of Workability | Evaluation Item 1 | B | B | A | B | B | B | B |
| | Evaluation Item 2 | B | B | A | B | B | B | A |
| | Comprehensive Evaluation | C | C | A | C | C | C | C |
| Evaluation of Rust Inhibiting Performance | Evaluation | C | C | C | C | C | C | A |

[Note]

In Table 1 and Table 2, numerical values with no description of unit are all (% by mass).

The phosphorus content is a content of phosphorus atom based on the total amount of the composition.

The nitrogen content is a content of nitrogen atom based on the total amount of the composition.

The results in Table 1 confirm that the metalworking oil compositions of Examples 1 to 8 are excellent in workability and rust inhibiting performance. On the other hand, the oil compositions of Comparative Examples 1 and 2 not containing the carboxylate (A) do not have satisfactory properties in point of both workability and rust inhibiting performance. The oil composition of Comparative Example 3 not containing the rust inhibitor (C) does not have satisfactory properties in point of rust inhibiting performance. Similarly to these, the oil compositions of Comparative Examples 5 and 6 not containing the rust inhibitor (C) do not have satisfactory properties in point of not only rust inhibiting performance but also workability. The oil composition of Comparative Example 7 not containing the phosphorus-containing compound (B) does not have satisfactory properties in point of workability.

INDUSTRIAL APPLICABILITY

Taking advantage of such properties thereof, the metalworking oil composition of the present embodiment can be favorably used, for example, for plastic working, especially for shearing work. In addition, the metalworking oil composition of the present embodiment has rust inhibiting performance, and therefore, in the case where a material to be worked is coated with a metalworking oil composition and then kept as such for a long period of time until metalworking, for example, in the case where a pre-process of coating is carried out in Japan and then a process of metalworking is carried out in foreign countries, use of the metalworking oil composition of the present embodiment is effective.

The materials to be worked using the metalworking oil composition of the present invention are not specifically limited, but the metalworking oil composition is especially favorably used for silicon steel plates.

The invention claimed is:

1. A metalworking oil composition:

comprising, as blended therein:

(A) 1-3.6 mass % of at least one fully esterified carboxylate selected from the group consisting of a polyhydric alcohol ester of a monocarboxylic acid;

(B) about 0.3-0.33 mass % of a triaryl phosphate; and (C) 0.3-1 mass % of at least one rust inhibitor selected from the group consisting of a sulfonate amine salt, an acylsarcosine compound and an imidazole compound, wherein: the monocarboxylic acid has 9 or more and 21 or less carbon atoms.

2. The metalworking oil composition according to claim 1, wherein the polyhydric alcohol constituting the polyhydric alcohol ester of a monocarboxylic acid is an aliphatic polyhydric alcohol.

3. The metalworking oil composition according to claim 1, wherein the monocarboxylic acid has 12 or more and 20 or less carbon atoms.

4. The metalworking oil composition according to claim 1, wherein the monocarboxylic acid has 12 or more and 18 or less carbon atoms.

5. The metalworking oil composition according to claim 1, wherein the polycarboxylic acid has 3 or more and 18 or less carbon atoms.

6. The metalworking oil composition according to claim 1, wherein the monohydric alcohol constituting the monohydric alcohol ester of a polycarboxylic acid is an aliphatic monohydric alcohol.

7. The metalworking oil composition according to claim 1, wherein the polycarboxylic acid constituting the monohydric alcohol ester of a polycarboxylic acid is an aromatic carboxylic acid.

8. The metalworking oil composition according to claim 1, wherein the monohydric alcohol constituting the monohydric alcohol ester of a polycarboxylic acid is an aliphatic alcohol having 9 or more and 21 or less carbon atoms.

9. The metalworking oil composition according to claim 1, wherein the (B) phosphorus-containing compound is at least one selected from the group consisting of a phosphate, an acid phosphate, a phosphite, an acid phosphite, and a phosphate amine salt.

10. The metalworking oil composition according to claim 1, further comprising:

(D) at least one base oil selected from the group consisting of a mineral oil and a synthetic oil, each having a kinematic viscosity at 40° C. of 0.5 $mm^2/s$ or more and 20 $mm^2/s$ or less.

11. The metalworking oil composition according to claim 1, which is adapted to function as a working oil for plastic working.

12. A metalworking method, comprising metal working a metal in contact with the metalworking oil composition of claim 1.

13. The metalworking oil composition according to claim 1, wherein the rust inhibitor is at least one selected from the group consisting of an alkylamine compound, a sulfonate amine salt, and an acylsarcosine compound.

14. The metalworking oil composition according to claim 1, wherein the rust inhibitor is an alkylamine compound.

15. The metalworking oil composition according to claim 1, wherein the rust inhibitor is a sulfonate amine salt.

16. The metalworking oil composition according to claim 1, wherein the rust inhibitor is an acylsarcosine compound.

17. The metalworking oil composition according to claim 1, wherein the rust inhibitor is an imidazole compound.

* * * * *